United States Patent [19]

Espagnacq et al.

[11] Patent Number: 4,724,018

[45] Date of Patent: Feb. 9, 1988

[54] PYROTECHNICAL COMPOSITION WHICH GENERATES SMOKE THAT IS OPAQUE TO INFRARED RADIANCE AND SMOKE AMMUNITION AS OBTAINED

[75] Inventors: André Espagnacq; Gérard D. Sauvestre, both of Bourges, France

[73] Assignee: Etat Francais, Paris, France

[21] Appl. No.: 517,939

[22] Filed: Jul. 27, 1983

[30] Foreign Application Priority Data

Jul. 27, 1982 [FR] France ..... 82 13054

[51] Int. Cl.[4] ..... C06G 27/00

[52] U.S. Cl. ..... 149/87; 149/21; 149/110; 149/117; 102/334

[58] Field of Search ..... 149/110, 117, 87, 92, 149/21, 37; 102/334

[56] References Cited

U.S. PATENT DOCUMENTS 4,096,005 6/1978 Slusher ..... 149/117 X
4,186,664 2/1980 Huber et al. ..... 102/334
4,238,254 12/1980 Prähauser et al. ..... 149/92 X
4,435,233 3/1984 Rayer et al. ..... 149/37 X

*Primary Examiner*—Stephen J. Lechert, Jr.
*Attorney, Agent, or Firm*—Parkhurst & Oliff

[57] ABSTRACT

The invention pertains to a smoke-producing pyrotechnical composition which is designed for the production of a smoke screen that prohibits the transmission of infrared radiance from a target to a pick-up.

It includes a compound which generates, through thermal decomposing, carbon particles of which the size is included between about 1 and 14 μm, and an oxidoreducing system which reacts at a temperature that exceeds 1000 degrees C. and a binding agent. The compound which generates carbon particles can be hexachloroethane, hexachlorobenzene, naphtalene, anthracene, or their mixture; the reducing agent can be a metal powder (magnesium) and the oxidizer hexachlorobenzene and/or hexachloroethane.

An application to the execution of smoke-producing devices.

13 Claims, No Drawings

PYROTECHNICAL COMPOSITION WHICH GENERATES SMOKE THAT IS OPAQUE TO INFRARED RADIANCE AND SMOKE AMMUNITION AS OBTAINED

The technical sector of this invention is that of smoke-producing pyrotechnical compositions which make it possible to camouflage any target by preventing the emission of infrared radiance transmitted by it to make it impossible to detect with a pick-up for instance a thermal camera.

At present there are very few publications which pertain to the production of a smoke screen which prevents the emission of infrared radiance transmitted by a target towards a pick-up and no other author has yet proposed the use of pyrotechnical composition to produce a smoke screen which is opaque to infrared radiance. On the other hand, many studies have been conducted with respect to classical smoke-producing compositions which produce a cloud of smoke to shield from the human eye any type of device. Hence, hexachloroethane and zinc oxide-based smoke-producing pyrotechnical compositions are well known to the man of the art and we can refer as an illustration to U.S. Pat. No. 2,939,779. This type of composition can generate a white smoke through the production of zinc chloride or ammonium chloride, carbon being transformed into carbonic gas. This type of composition is absolutely ineffective with regard to radiance pick-ups that are sensitive in the wave length band between 1 and 14 μm. It should be noted that transparency windows in the atmosphere must be taken into account, which are used to receive thermal radiance. The most commonly used two windows are:

the window 3–5 μm the window 7–14 μm

Therefore we use especially those two windows to study transmission or absorption of those smoke-producing compositions.

The function of the smoke-producing compositions which are opaque to infrareds is to prevent the infared radiance that is transmitted by any body either by absorption, by diffusion, by diffraction, or by thermal superimposition, or by intense thermal transmission which is specific to the smoke-producing composition proper (case of infrared decoys) which is superimposed onto the thermal image of the target to be shielded.

We have already suggested the use of an aerosol which includes fine droplets or solid particles that are scattered by a vector gas to shield the infrared radiance of a body.

French Pat. Nos. 2,299,617 and 2,309,828 describe the forming of a liquid aerosol through the reaction between titanium or tin tetrachloride with water according to the reaction:

$$TiCl_4+4H_2O \rightarrow Ti(OH)_4+4HCl$$

We then use a scattering pyrotechnical composition, which is highly exothermal, of aluminum or boron/-potassium perchlorate in order to scatter titanium tetrachloride. However, this kind of aerosol which is comprised of liquid hydrosoluble droplets is not all effective and has an extremely short lifespan, which is lower than 20s regardless of the volume of the scattering system. We also notice that this type of composition generates acid, corroding and toxic droplets.

We also know French Pat. No. 2,396,265 which describes the scattering of solid particles from a mineral powder and a vector gas. However we must control the granulometry of the particles which are contained in the emitted aerosol because only one final granulometry close to the wave length of the radiance to be opaqued is effective. Nevertheless, we observed that the production of an aerosol made of cold solid particles of which the diameter might be included between 1 and 14 μm does not allow for use to eliminate the thermal image effectively and for a lapse of time which is sufficient due to the sedimenting of particles which intervenes. The lifespans which are obtained do not exceed 25 seconds, except for constant aerosol emission.

French Pat. Nos. 2,294,422 and 2,294,432 describe infrared decoys which transmit, through combustion of a pyrotechnical composition, a high intensity flame which thus defines a source of infrared radiance which can be substituted to the source of radiance which is comprised of the engine of the aircraft in the guidance system of the device which is launched asainst it. This is not a question of forming a shielding screen to opaque the target infrared radiance, but to saturate the pick-up.

The purpose of this invention is a new pyrotechnical composition which produces a screen that makes it impossible to transmit infrared radiance in order to shield completely a target for a sufficient lapse of time, or from 40 to 50s.

Therefore, the invention concerns a pyrotechnical composition which is dseigned to produce smoke which is opaque to infrared radiance of a target towards a thermal pick-up, characterized in that it includes a generating compound, through thermal decomposing, of carbon particles of which the size is included between about 1 and 14 μm, an oxidoreducing system which reacts at a temperature above 1000 degrees C. and a binding agent.

The compound which generates carbon particles can be made of hexachloroethane, hexachlorobenzene, naphthalene, anthracene or a mixture of the above.

The reducing agent can be selected among metal powders and the oxidizing agent can be represented be hexachlorobenzene, hexachloroethane, or their mixture.

The composition according to the invention can include the following ternary system:

15 to 25 parts in weight of metal powder 50 to 85 parts in weight of hexachlorobenzene or hexachloroethane, 0 to 30 parts of naphtalene.

Advantageously, the metal powder is a magnesium powder.

The invention also pertains to smoke-producing ammunition which includes a pyrotechnical composition to produce smoke with is opaque to infared radiance.

An advantage of the pyrotechnical composition and of the smoke-producing ammunition according to the invention rests in the fact that the cloud of smoke which is opaque to infrareds is comprised of fine carbon particles which are generated chemically in a homogeneous fashion with a sufficient output.

Another advantage rests in the fact that it is possible to control the following vital factors:

the combustion speed of the composition, which makes it possible to obtain sufficient massic outflow, the combustion temperature which must be high and which conditions the proper granulometric distribution of carbon particles.

Other advantages of the smoke-producing pyrotechnical composition will be better understood with the additional description which follows on the specific implementation modes that are provided as examples.

In order to prepare the pyrotechnical composition according to the invention we must proceed as follows or in an equivalent way:

First the metal powder is subjected to stoving at about 50 degrees C. for 24 hours. The solid compounds like hexachlorobenzene and anthracene are passed through an AFNOR sifter of about 0.50–0.65 mm. Then they are introduced in turn inside the vat of a mixer and mixed for 15 to 30 minutes. From the obtained mixture, we achieve tablets which include a central channel under pressure of about $6 \cdot 10^7$ Pa.

According to the invention, we use a carbon particle-generating compound in order to produce a screen that is opaque to infrared radiance. We can therefore use paraffins, condensed or not benzenic compounds (naphthalene, anthracene, phenanthrene, naphthol); naphthalene and anthracene especially make it possible to obtain good results. The oxidoreducing system must provide a combustion temperature which exceeds 1000 degrees C.; the metal powders associated to existing oxidizers of the nitrate or perchlorate type can be used. However, we prefer, according to the invention, to optimize the pyrotechnical composition by using a compound which generates carbon particles which must be sufficiently oxidizing to react with the reducing agent. hence, the hydrocarbonic compounds which are partially or completely substituted by halide electronegative elements such as chlorine and fluoride, already generating carbon particles, are perfectly suited, and can be associated to non substituted carbonic compounds. As an example, the hexachlorobenzene naphthalene couple makes it possible to achieve pyrotechnical compositions which generate an intense smoke that is opaque to infrared radiance. Obviously, we can use a substituted hydrocarbonic compound in combination with a classical oxidizer. As such the binding agent does not represent a characteristic of the invention and it is used to reinforce the mechanical hold of the composition. However, we will select preferably the macromolecular compounds of the fluoridated kind which participates in the combustion reaction by bringing in highly oxidizing fluoride molecules for instance vinylidene polyfluoride, but we can also mention other binding agents such as acetate copolymer, vinyl acetochloride copolymer, reticulated or not, polystyrene, methyl/styrene methacrylate copolymer, and neoprene. The proportion of binding agent can amount to about 5 to 20 parts not to exeed 25 parts.

For each composition indicated below we measured the combustion speed, the mechanical hold, the shielding potential, the absorption coefficient as well as aging.

Combustion speed is measured on a cylindrical tube which is 3 cm long and 3 cm in diameter achieved under $6–10^7$ Pa compression.

Shielding potential is measured with a thermal camera that works in the 0.3–5.6 μm band placed at 4.5 m from a transmitter comprised of an extended source with a 20 cm side brought to 200 degrees C. in a tunnel. The shielding potential of the smoke can be defined as the lapse of time during which the image of the extended source is partially or totally erased by the passage of smoke between the camera and the extended source.

The absorption coefficient $A_{\Delta\lambda}$ ($m^{-1}$) is measured on a wave length band of 0.3 to 0.6 μm by applying the Beer law.

In table I, we gathered the results of the combustion speed and mechanical hold measurements which are defined below.

combustion: we measure the combustion in open air V (latm) and the combustion speed under pressure inside a smoke-producing ammunition V (P) which is ready to use; or comprised of a 36 cm long and 8 cm in diameter smoke-producing pot;

mechanical hold: we measure Smc (maximal constraint under uniaxial compression) and emc (distortion for maximal constraint)

hold during aging: (1) we subject the pyrotechnical compositions to respective temperatures of −40 degrees C. and +51 degrees C. for one month and we measure the previous mechanical characteristics.

(2) on the one hand we measure the loss of mass by sublimiting the constituents of the composition after aging and on the other hand the dilating of the tablet.

friction sensitivity coefficients (csF) and csi friction (according to the respective operational modes GEMO EMD-440A and GEMO FHD-410-B1).

We achieve the various following compositions as tablets with the previous steps which we test as stated above:

COMPOSITION 1

20 parts of magnesium powder,
80 parts of hexachlorobenzene,
10 parts of naphthalene,
10 parts of vinylidene polyfluoride.

COMPOSITION 2

20 parts of magnesium powder,
70 parts of hexachlorobenzene,
10 parts of naphthalene,
5 parts of neoprene.

COMPOSITION 3

20 parts of magnesium powder,
70 parts of hexachlorobenzene,
10 parts of naphthalene,
5 parts of vinylidene polyfluoride.

COMPOSITION 4

18.5 parts of magnesium powder,
61.5 parts of hexachloroethane,
30 parts of naphthalene
20 parts of chlorinated paraffin,
20 parts of vinylidene polyfluoride.

COMPOSITION 5

20 parts of magnesium powder,
80 parts of hexachlorobenzene,
5 parts of polyvinyl acetate.

COMPOSITION 6

20 parts of magnesium powder,
80 parts of hexachlorobenzene,
20 parts of vinylidene polyfluoride.

TABLE 1

| Criteria | |
|---|---|
| V latm (mm/s) | 0.57 |
| VP (mm/s) | 0.1 |
| Smc ($10^5$ Pa) | 178 |

TABLE 1-continued

| Criteria | | |
|---|---|---|
| emc % | | 0.87 |
| Smc ($10^5$ Pa): | −40 degrees C. | 175 |
| after one month: | +51 degrees C. | 144 |
| emc (%): | −40 degrees C. | 1.01 |
| after one month: | +51 degrees C. | 0.77 |
| Mass loss (%): | −40 degrees C. | −0.7 |
| after 7 days at: | +51 degrees C. | 1.8 |
| Mass loss (%): | −40 degrees C. | −0.8 |
| after one month at: | +51 degrees C. | 4 |
| Dilating (%) after: | −40 degrees C. | nil |
| 1 month at: | +51 degrees C. | +0.2 |
| csF (%) under 353 N | | 0 |
| csi (%) under 100 J | | 0 |

The results that were obtained indicate that the physical and chemical properties of the composition tablets prepared according to the invention do not vary in time.

In table Ii, we gathered the values obtained for the absorption A coefficient and the shielding potential.

TABLE II

| | | SHIELDING POTENTIAL Δλ2 to 5.6 μm | |
|---|---|---|---|
| | $A_{\Delta\lambda}$ 0.3 to 6 μm | total period of shielding in s | partial period of shielding in s |
| 1 | 0.95 | 8 | 45 |
| 2 | | 0 | 50 |
| 3 | | 7 | 60 |
| 4 | 0.92 | 2.5 | 20 |
| 5 | 0.76 | 0 | 5 |
| 6 | 1.03 | | |

We claim:

1. A smoke-producing pyrotechnical composition, said composition being capable of production of a smoke screen which prohibits the transmission of infrared radiance from a target towards a pick-up, said composition comprising a compound which generates, with thermal decomposing, carbon particles of a size between about 1 and 14 μm, an oxidoreducing system which reacts at a temperature which exceeds 1000 degrees C., and a binding agent.

2. A composition according to claim 1, characterized in that the compound which generates carbon particles comprises at least one member of the group consisting of hexachloroethane, hexachlorobenzene, naphthalene and anthracene.

3. A composition according to claim 1, characterized in that the reducing oxidizer is selected from among metal powders and in that the oxidizer is at least one member of the group consisting of hexachlorobenzene and hexachloroethane.

4. A composition according to claim 3, characterized in that it includes the following ternary system:

15 to 25 parts in weight of metal powder, 50 to 85 parts in weight of hexachlorobenzene or hexachloroethane, 0 to 30 parts of naphthalene.

5. A composition according to claim 4, characterized in that the metal powder is magnesium powder.

6. A composition according to claim 5, characterized in that it includes the following constituents:

20 parts of magnesium, 80 parts of hexachlorobenzene, 10 parts of naphthalene 10 parts of binding agent represented by vinylidene polyfluoride.

7. A composition according to claim 5, characterized in that it includes the following constituents:

20 parts of magnesium powder, 70 parts of hexachlorobenzene, 10 parts of naphthalene, 5 parts of binding agent represented by neoprene.

8. A composition according to claim 5, characterized in that it includes the following constituents:

20 parts of magnesium powder, 70 parts of hexachlorobenzene, 10 parts of naphthalene, 5 parts of binding agent represented by vinylidene polyfluoride.

9. A composition according to claim 5, characterized in that it includes the following constituents:

20 parts of magnesium powder, 70 parts of hexachlorobenzene, 10 parts of naphthalene 10 parts of binding agent represented by vinylidene polyfluoride.

10. A composition according to claim 5, characterized in that it includes the following constituents:

18.5 parts of magnesium powder, 61.5 parts of hexachloroethane, 30 parts of naphthalene, 20 parts of chlorinated paraffin, 20 parts of binding agent represented by vinylidene polyfluoride.

11. A composition according to claim 5, characterized in that it includes the following constituents:

20 parts of magnesium powder, 80 parts of hexachlorobenzene, 20 parts of binding agent comprised of polyvinyl acetate.

12. A composition according to claim 5, characterized in that it includes the following constituents:

20 parts of magnesium powder, 80 parts of hexachlorobenzene, 20 parts of vinylidene polyfluoride.

13. Smoke-producing ammunition, comprising the pyrotechnical composition of claim 1.

* * * * *